US008221159B2

(12) United States Patent
Knepp

(10) Patent No.: US 8,221,159 B2
(45) Date of Patent: Jul. 17, 2012

(54) AUDIO PATCHBAY/BREAKOUT PANEL

(76) Inventor: Thomas William Knepp, Malvern, PA (US)

( * ) Notice: Subject to any disclaimer, the term of this patent is extended or adjusted under 35 U.S.C. 154(b) by 112 days.

(21) Appl. No.: 12/890,316

(22) Filed: Sep. 24, 2010

(65) Prior Publication Data

US 2011/0081802 A1 Apr. 7, 2011

Related U.S. Application Data

(60) Provisional application No. 61/277,424, filed on Sep. 25, 2009.

(51) Int. Cl.
*H01R 13/60* (2006.01)

(52) U.S. Cl. ..... 439/540.1; 439/49

(58) Field of Classification Search ..... 439/540.1, 439/49

See application file for complete search history.

(56) References Cited

U.S. PATENT DOCUMENTS

| | | | | |
|---|---|---|---|---|
| 5,396,405 | A * | 3/1995 | Reed et al. | 361/827 |
| 5,677,959 | A * | 10/1997 | Silfvast | 381/77 |
| 6,078,507 | A * | 6/2000 | Tronolone et al. | 439/579 |
| 6,717,486 | B2 * | 4/2004 | Khemakhem et al. | 333/24 R |
| 2002/0182931 | A1 * | 12/2002 | Ortowski et al. | 439/540.1 |
| 2003/0012362 | A1 * | 1/2003 | Khemakhem et al. | 379/398 |
| 2006/0118321 | A1 * | 6/2006 | Herring et al. | 174/101 |
| 2007/0163801 | A1 * | 7/2007 | Coffey et al. | 174/250 |
| 2010/0184323 | A1 * | 7/2010 | Patel et al. | 439/490 |

* cited by examiner

*Primary Examiner* — Briggitte R Hammond

(57) ABSTRACT

A patchbay includes a front panel, a rear panel, and a circuit board with conducting traces. The front panel has mounted thereon a plurality of XLR/TRS combination jacks, and sets of pairs of TRS jacks. The rear panel has five DB25 connectors. The circuit board extends from the front panel to the rear panel; each set of three conducting traces forms a channel connected to one of the DB25 connectors. The DB25 connectors connect to channels for Mic in, Line in, Preamp out, A/D in, and D/A out, respectively. Each XLR/TRS combination jack is connected to a Mic in channel and to a Line in channel. One of each pair of TRS jacks in the first set is connected to a Preamp out channel and the other is connected to an A/D in channel. Each TRS jack in the second set is connected to a D/A out channel.

14 Claims, 8 Drawing Sheets

FIG. 6A

| 61 | 62 | 63 | 64 |
|---|---|---|---|
| C1-1 | D1-25 | C1-S | D2-25 |
| C1-3 | D1-12 | C1-R | D2-12 |
| C1-2 | D1-24 | C1-T | D2-24 |
| C2-1 | D1-11 | C2-S | D2-11 |
| C2-3 | D1-23 | C2-R | D2-23 |
| C2-2 | D1-10 | C2-T | D2-10 |
| C3-1 | D1-22 | C3-S | D2-22 |
| C3-3 | D1-9 | C3-R | D2-9 |
| C3-2 | D1-21 | C3-T | D2-21 |
| C4-1 | D1-8 | C4-S | D2-8 |
| C4-3 | D1-20 | C4-R | D2-20 |
| C4-2 | D1-7 | C4-T | D2-7 |
| C5-1 | D1-19 | C5-S | D2-19 |
| C5-3 | D1-6 | C5-R | D2-6 |
| C5-2 | D1-18 | C5-T | D2-18 |
| C6-1 | D1-5 | C6-S | D2-5 |
| C6-3 | D1-17 | C6-R | D2-17 |
| C6-2 | D1-4 | C6-T | D2-4 |
| C7-1 | D1-16 | C7-S | D2-16 |
| C7-3 | D1-3 | C7-R | D2-3 |
| C7-2 | D1-15 | C7-T | D2-15 |
| C8-1 | D1-2 | C8-S | D2-2 |
| C8-3 | D1-14 | C8-R | D2-14 |
| C8-2 | D1-1 | C8-T | D2-1 |

FIG. 6B

| 65 | 66 | 67 | 68 |
|---|---|---|---|
| S1-ST | D3-25 | S1-SB | D4-25 |
| S1-RT | D3-12 | S1-RB | D4-12 |
| S1-TT | D3-24 | S1-TB | D4-24 |
| S2-ST | D3-11 | S2-SB | D4-11 |
| S2-RT | D3-23 | S2-RB | D4-23 |
| S2-TT | D3-10 | S2-TB | D4-10 |
| S3-ST | D3-22 | S3-SB | D4-22 |
| S3-RT | D3-9 | S3-RB | D4-9 |
| S3-TT | D3-21 | S3-TB | D4-21 |
| S4-ST | D3-8 | S4-SB | D4-8 |
| S4-RT | D3-20 | S4-RB | D4-20 |
| S4-TT | D3-7 | S4-TB | D4-7 |
| S5-ST | D3-19 | S5-SB | D4-19 |
| S5-RT | D3-6 | S5-RB | D4-6 |
| S5-TT | D3-18 | S5-TB | D4-18 |
| S6-ST | D3-5 | S6-SB | D4-5 |
| S6-RT | D3-17 | S6-RB | D4-17 |
| S6-TT | D3-4 | S6-TB | D4-4 |
| S7-ST | D3-16 | S7-SB | D4-16 |
| S7-RT | D3-3 | S7-RB | D4-3 |
| S7-TT | D3-15 | S7-TB | D4-15 |
| S8-ST | D3-2 | S8-SB | D4-2 |
| S8-RT | D3-14 | S8-RB | D4-14 |
| S8-TT | D3-1 | S8-TB | D4-1 |

| 69 | 70 |
|---|---|
| S9-ST | D5-25 |
| S9-RT | D5-12 |
| S9-TT | D5-24 |
| S9-SB | D5-11 |
| S9-RB | D5-23 |
| S9-TB | D5-10 |
| S10-ST | D5-22 |
| S10-RT | D5-9 |
| S10-TT | D5-21 |
| S10-SB | D5-8 |
| S10-RB | D5-20 |
| S10-TB | D5-7 |
| S11-ST | D5-19 |
| S11-RT | D5-6 |
| S11-TT | D5-18 |
| S11-SB | D5-5 |
| S11-RB | D5-17 |
| S11-TB | D5-4 |
| S12-ST | D5-16 |
| S12-RT | D5-3 |
| S12-TT | D5-15 |
| S12-SB | D5-2 |
| S12-RB | D5-14 |
| S12-TB | D5-1 |

FIG. 6C

| 71 | 72 |
|---|---|
| S1-TT | S1-TNB |
| S1-RT | S1-RNB |
| S1-ST | S1-SNB |
| S2-TT | S2-TNB |
| S2-RT | S2-RNB |
| S2-ST | S2-SNB |
| S3-TT | S3-TNB |
| S3-RT | S3-RNB |
| S3-ST | S3-SNB |
| S4-TT | S4-TNB |
| S4-RT | S4-RNB |
| S4-ST | S4-SNB |
| S5-TT | S5-TNB |
| S5-RT | S5-RNB |
| S5-ST | S5-SNB |
| S6-TT | S6-TNB |
| S6-RT | S6-RNB |
| S6-ST | S6-SNB |
| S7-TT | S7-TNB |
| S7-RT | S7-RNB |
| S7-ST | S7-SNB |
| S8-TT | S8-TNB |
| S8-RT | S8-RNB |
| S8-ST | S8-SNB |

FIG 7

AUDIO PATCHBAY/BREAKOUT PANEL

CROSS-REFERENCE TO RELATED APPLICATIONS

This application claims the benefit of U.S. Provisional Application No. 61/277,424, filed Sep. 25, 2009.

FIELD OF THE DISCLOSURE

This disclosure relates to digital audio recording equipment, and more particularly to patchbays and breakout panels used for multi-channel interfacing between other units.

BACKGROUND OF THE DISCLOSURE

A patchbay (also called a patch panel or breakout panel) is a panel, typically rackmounted, providing cable connections. Cables connect to devices (e.g. jacks) at both front and rear faces of the patchbay. The devices are arranged so that a number of circuits, usually of the same or similar type, appear on jacks for monitoring, interconnecting, and testing circuits in a convenient, flexible manner. Patchbays offer the convenience of allowing technicians to quickly change the path of select signals, without the expense of dedicated switching equipment.

Patchbays are used in various settings (e.g. recording studios, television and radio broadcast studios, and concert sound reinforcement systems) to connect different devices, such as microphones, electric or electronic instruments, effects (e.g. compression, reverb, etc.), recording gear, amplifiers, and the like.

It often is desirable to organize and prepare analog signals for use in a digital environment, particularly in the arena of portable systems. In a typical arrangement, a multi-channel preamp and an analog to digital and digital to analog (all in one) converter are interfaced with a computer running some type of music software. These preamps and converters can be quite expensive; accordingly, it is desirable to provide only a single set of them, connected to a patchbay, which then permits access by a number of other units. Additionally, a patch point between the preamps and converters should be provided for analog signal processing such as dynamics and equalization prior to conversion to digital. Furthermore, it is desirable to lead outputs from the digital to analog converter to connectors suitable for connection to mixers, recorders, monitors, etc.

Among modern equipment manufacturers of products utilized in the recording of digital audio, many have adopted the use of the DB25 connector to simplify multi-channel interfacing between units. A single DB25 connector is capable of carrying 8 discrete channels of balanced analog audio and 16 channels of digital signals. Any two pieces of equipment using the same standard pinout in the DB25 connector can be easily interfaced using simple and inexpensive DB25 cable assemblies, available in several configurations industry wide.

Accordingly, it is desirable to implement a patchbay incorporating DB25 connectors and also suitable for organizing analog signals.

SUMMARY OF THE DISCLOSURE

In accordance with the disclosure, a patchbay is provided including a front panel having XLR and TRS jacks, a rear panel having DB25 connectors, and a circuit board with conducting traces. In an embodiment of the disclosure, the front panel has mounted thereon a plurality of XLR/TRS combination jacks; a first set of pairs of TRS jacks; and a second set of pairs of TRS jacks. The rear panel has five DB25 connectors. The circuit board extends from the front panel to the rear panel; the circuit board has conducting traces, each set of three conducting traces forming a channel connected to one of the DB25 connectors. The DB25 connectors connect to channels for Mic in, Line in, Preamp out, ND in, and D/A out, respectively. Each of the XLR/TRS combination jacks is connected to a Mic in channel and to a Line in channel. One of each pair of the TRS jacks in the first set is connected to a Preamp out channel and the other of that pair is connected to an A/D in channel. Each of the TRS jacks in the second set is connected to a D/A out channel.

In this embodiment, each of the five DB25 connectors mounted on the rear panel is configured to connect to eight channels; the front panel has eight XLR/TRS combination jacks mounted thereon; the first set comprises eight pairs of TRS jacks; and the second set comprises four pairs of TRS jacks. The first set of pairs of TRS jacks comprises an insert section, and the second set of pairs of TRS jacks comprises an output section; the pairs of TRS jacks in the insert section are configured for half-normalled operation. The circuit board is a two-layer printed circuit board, and the combination jacks, the TRS jacks and the DB25 connectors are soldered directly to the circuit board.

The foregoing has outlined, rather broadly, the preferred features of the present disclosure so that those skilled in the art may better understand the detailed description of the disclosure that follows. Additional features of the disclosure will be described hereinafter that form the subject of the claims of the disclosure. Those skilled in the art should appreciate that they can readily use the disclosed conception and specific embodiment as a basis for designing or modifying other structures for carrying out the same purposes of the present disclosure and that such other structures do not depart from the spirit and scope of the disclosure in its broadest form.

BRIEF DESCRIPTION OF THE DRAWINGS

FIG. 6A shows how pins of the front panel XLR/TRS combo jacks connect with pins of the rear panel DB25 connectors, in accordance with an embodiment of the disclosure.

FIGS. 6B-6C shows how pins of the front panel TRS jacks connect with pins of the rear panel DB25 connectors, in accordance with an embodiment of the disclosure.

FIG. 7 shows the arrangement of normalling jumpers on the TRS jacks.

DETAILED DESCRIPTION

Figure 1:
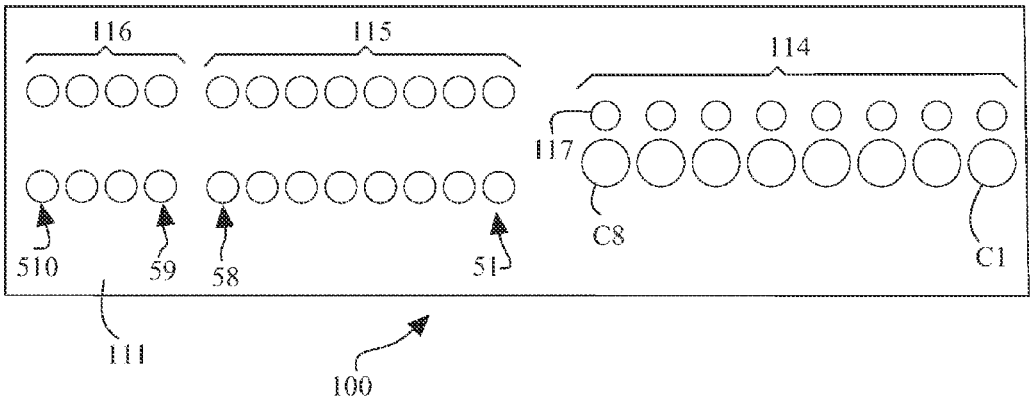
FIG. 1 is a schematic view of the front panel of a patchbay according to an embodiment of the disclosure.
Figure 2:
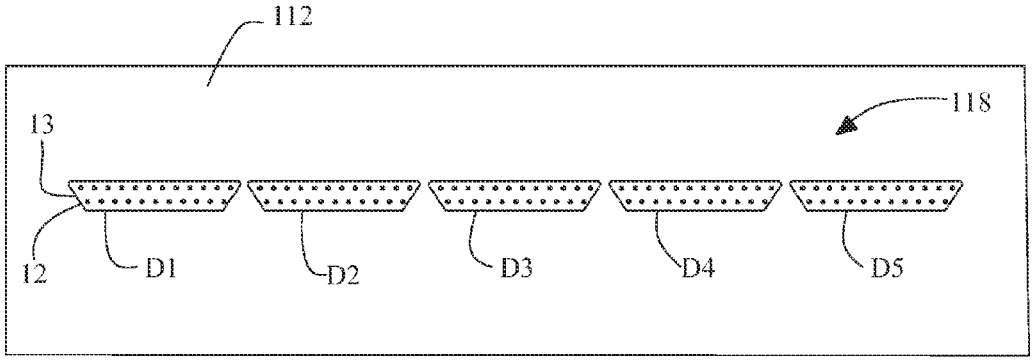
FIG. 2 is a schematic view of the rear panel of a patchbay according to an embodiment of the disclosure.

The front and rear panels of a patchbay 100, according to an embodiment of the disclosure, are shown in FIGS. 1 and 2 respectively. Patchbay 100 has a front panel 111 with both XLR/TRS combination (combo) jacks and TRS jacks, and a rear panel 112 with DB25 connectors. Patchbay 100 is designed as a rear-facing rack mount panel providing access to the inputs and outputs of the chosen preamps and converters without the need to sort through multiple connectors hanging from the rear of the rack.

As shown in FIG. 1, the front panel 111 has a section 114 of eight combination (combo) jacks C1-C8, each of which feature an XLRF connection and a TRSF connection. The front panel also includes twelve pairs of TRS jacks (Tip-Ring-Sleeve) S1-S12. Each pair of TRS jacks is installed so that it has a top (T) and a bottom (B) jack, to form a top row and a bottom row of twelve jacks each. The TRS jacks are in two sections: an insert section 115 with pairs S1-S8, and an output section 116 with pairs S9-S12.

As shown in FIG. 2, the rear panel 112 has five DB25 connectors D1-D5.

Figure 3:
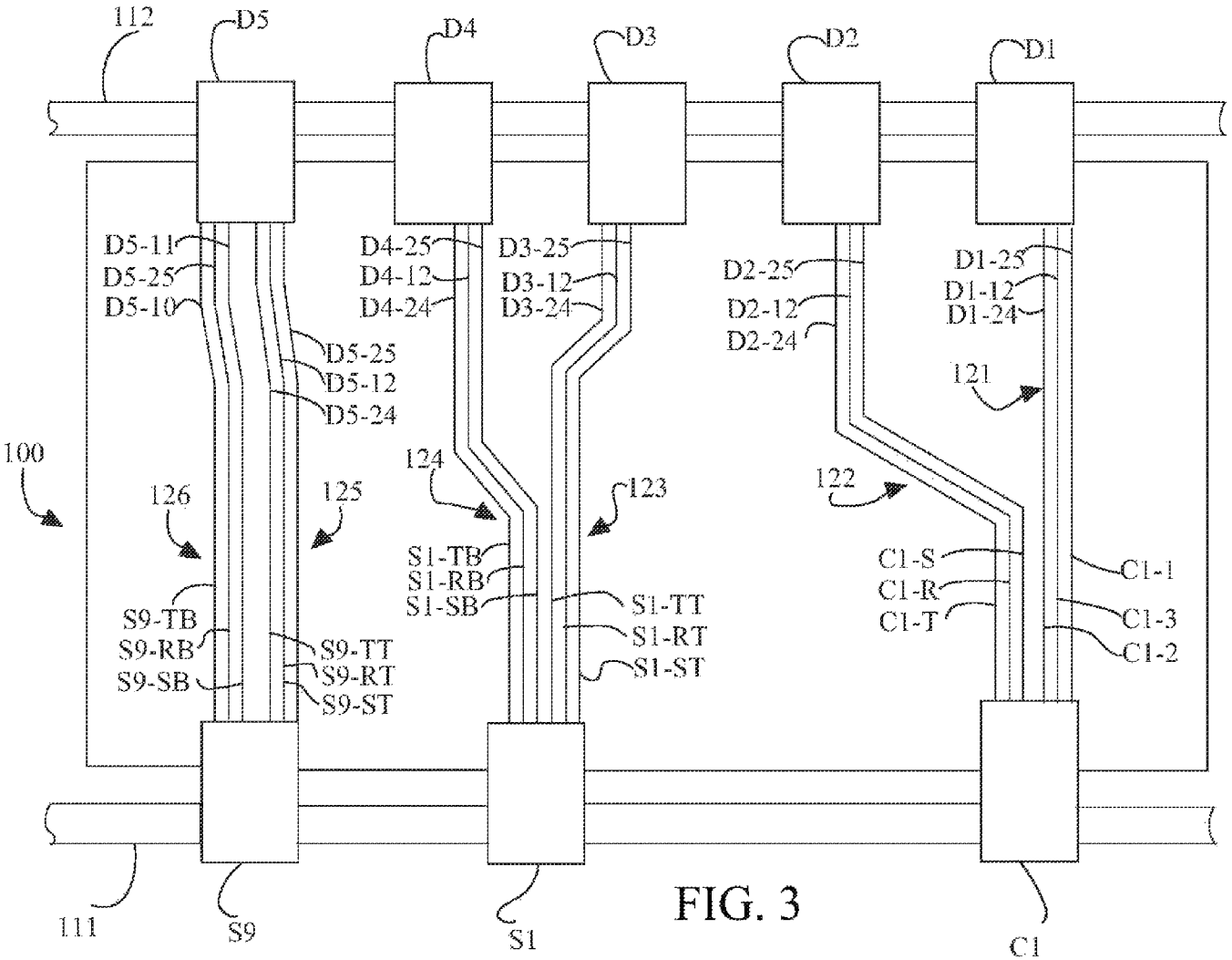
FIG. 3 is a schematic plan view of the interior of the patchbay of FIGS. 1 and 2, showing a printed circuit board with traces between connectors at the front and rear panels.

FIG. 3 is a schematic interior plan view of a circuit board 120 extending between panel 111 and rear panel 112, in accordance with an embodiment of the disclosure. All of the connector units (combo jacks C1-C8 and pairs of TRS jacks S1-S12) are soldered directly to the board 120. The board is attached to the chassis by the connector mounting hardware.

Circuit board 120 is a single two layer printed circuit board (PCB) with five groups of signals passing across it. Each group has eight balanced audio signal channels and each channel has three signal traces on the PCB. There are thus 24 traces per group. Each group of 24 traces passes between a DB25 connector 118 on the rear panel and a group of connectors, either XLR or TRS, on the front panel.

The arrangement of traces on circuit board 120 in this embodiment is shown schematically in FIG. 3. To preserve clarity, connections for only one unit in each section 114-116 (that is, C1, S1 and S9) are shown.

Figure 8:
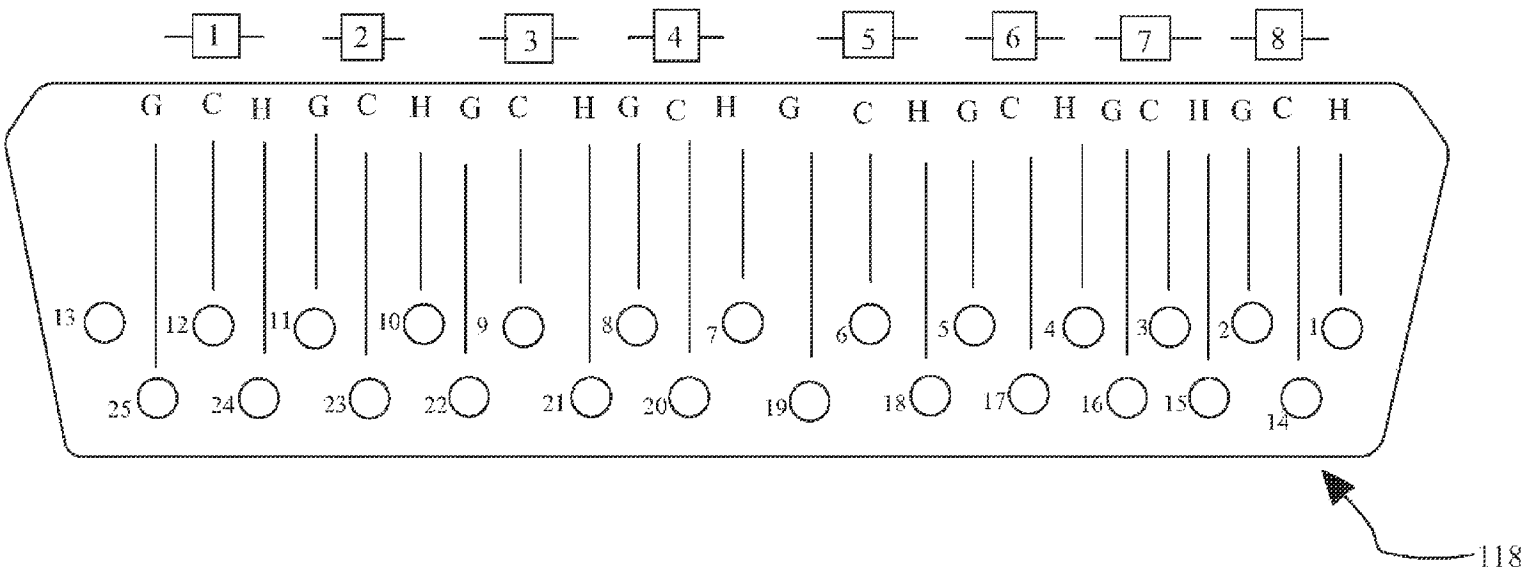
FIG. 8 is a detail view of a rear panel DB25 connector.

Combo jack C1 makes six connections with the PCB: XLR connections C1-1, C1-2, and C1-3, and TRS connections C1-S, C1-R, and C1-T, Channel 121 has three traces which conduct the XLR signals from jack C1 on front panel 111 to DB25 connector D1 on rear panel 112. Specifically, XLR connections C1-1, C1-3, C1-2 lead to pins D1-25, D1-12, D1-24 respectively. This assignment of traces to DB25 pins is consistent with the TASCAM pinout arrangement of Ground, Cold, Hot (G, C, H) in each of eight sets 1-8 of pins on the DB25 connector (see FIG. 8). The XLR signals from the other combo jacks also connect to D1, so that DB25 connector D1 has eight Mic in channels. A complete list of the XLR connections 61 of combo jacks C1-C8, and their associated DB25 connections 62, is shown in FIG. 6A.

Channel 122 has three traces which conduct the TRS signals from jack C1 on front panel 111 to DB25 connector D2 on rear panel 112. Specifically, TRS connections C1-S, C1-R, C1-T lead to pins D2-25, D2-12, D2-24 respectively. The TRS signals from the other combo jacks also connect to D2, so that DB25 connector D2 has eight Line in channels. A complete list of the TRS connections 63 of combo jacks C1-C8, and their associated DB25 connections 64, is shown in FIG. 6A.

Channel 123 has three traces which conduct the TRS signals from the top jack of S1 on front panel 111 to DB25 connector D3 on rear panel 112. Specifically, TRS connections S1-ST, S1-RT, S1-TT lead to pins D3-25, D3-12, D3-24 respectively. The TRS signals from the other top jacks in insert section 115 also connect to D3, so that DB25 connector D3 has eight Preamp out channels. A complete list of the TRS connections 65 of the top jacks of S1-S8, and their associated DB25 connections 66, is shown in FIG. 6B.

Channel 124 has three traces which conduct the TRS signals from the bottom jack of S1 on front panel 111 to DB25 connector D4 on rear panel 112. Specifically, TRS connections S1-SB, S1-RB, S1-TB lead to pins D4-25, D4-12, D4-24 respectively. The TRS signals from the other bottom jacks in insert section 115 also connect to D4, so that DB25 connector D4 has eight A/D in channels. A complete list of the TRS connections 67 of the bottom jacks of S1-S8, and their associated DB25 connections 68, is shown in FIG. 6B.

Channel 125 has three traces which conduct the TRS signals from the top jack of S9 on front panel 111 to DB25 connector D5 on rear panel 112. Specifically, TRS connections S9-ST, S9-RT, S9-TT lead to pins D5-25, D5-12, D5-24 respectively.

Channel 126 has three traces which conduct the TRS signals from the bottom jack of S9 on front panel 111 to DB25 connector D5 on rear panel 112. Specifically, TRS connections S9-SB, S9-RB, S9-TB lead to pins D5-11, D5-23, D5-10 respectively. The TRS signals from the other jacks in output section 116 also connect to D5, so that DB25 connector D5 has eight D/A out channels. A complete list of the TRS connections 69 of the top and bottom jacks of S9-S12, and their associated DB25 connections 70, is shown in FIG. 6C.

In this embodiment, connections to each of the DB25 connectors D1-D5 use the standard TASCAM pinout (see FIG. 8) for eight channels of balanced analog audio.

Figure 4A:
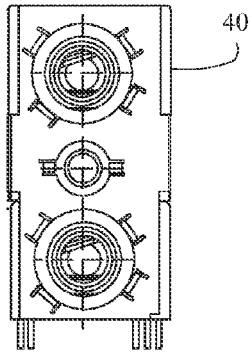
FIGS. 4A-4C are front, side and top views respectively of a pair of TRS jacks used in an embodiment of the disclosure.
Figure 4B:
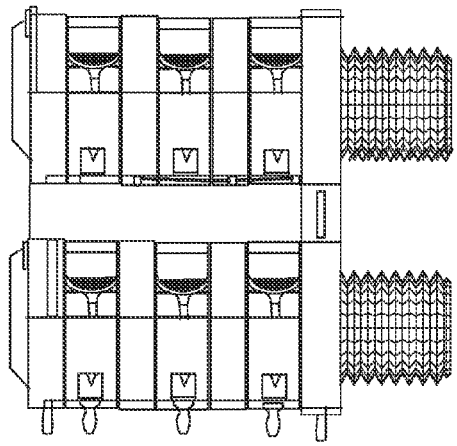
Figure 4C:
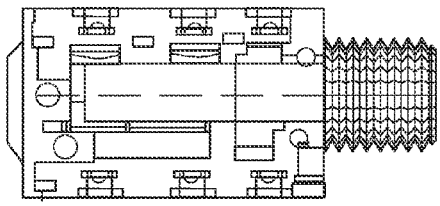
Figure 4D:
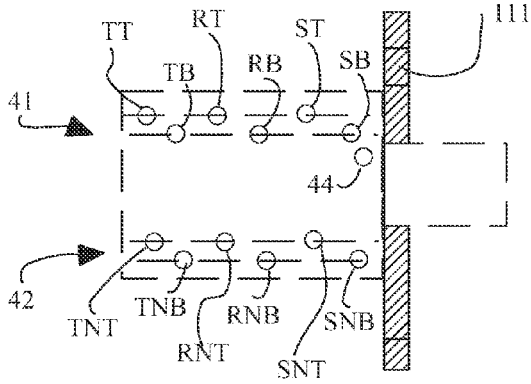
FIG. 4D is a schematic plan view of connections between the pair of TRS jacks and the printed circuit board of FIG. 3.

FIGS. 4A-4C are front, side and top views respectively of a connector unit 40 (a pair of TRS jacks, that is, a representative one of S1-S12) used in an embodiment of the disclosure. FIG. 4D illustrates the arrangement of connections between unit 40 and the printed circuit board. FIG. 4D is a top plan view, so that a cross section of front panel 111 with a mounting hole therethrough is shown, the profile of unit 40 is shown by a dashed line. The connector unit makes a ground connection 44 to the PCB. A set of solder connections 41 connect traces of the PCB to the Tip, Ring and Sleeve connectors of the top (T) and bottom (B) jacks respectively. A set of connections 42 is also provided for full-normal and half-normal operation.

In this embodiment, the top row and bottom row of the insert section are configured for "half-normalled" operation; the top jack of each pair is internally linked to the bottom jack via break contacts on the bottom jack. Accordingly, when no connectors are connected, the signals from DB25 connector D3 pass to DB25 connector D4. Inserting a TRSM connector (e.g. a patch cord) into the top jack will take a feed off that jack while retaining the internal link between the two jacks. Only when a TRSM connector is inserted into a bottom row jack (thus connecting to DB25 connector D4) will the "normalling" be broken; inserting a patch cord into the bottom jack will break the internal link and replace the signal feed from the top jack with the signal carried on the patch cord. This enables the top row to be used as sends to any outboard equipment, such as mixers, recorders, or signal processing devices. The bottom row can be used either as a corresponding return or as a direct input to the ND converter. A complete list of normalling jumper connections from the top jacks 71 of S1-S8, to the bottom jacks 72 of S1-S8 is shown in FIG. 7.

Figure 5A:
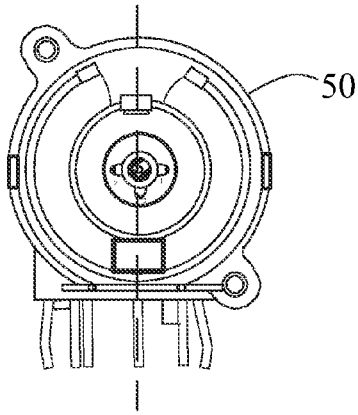
FIGS. 5A-5C are front, side and top views respectively of an XLR/TRS combo jack used in an embodiment of the disclosure.
Figure 5B:
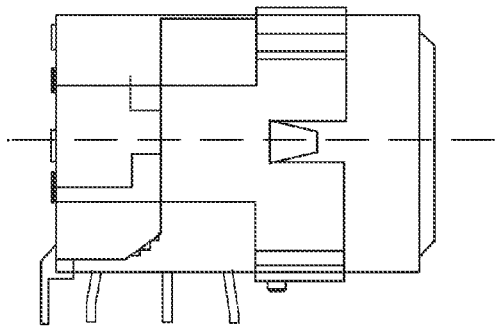
Figure 5C:
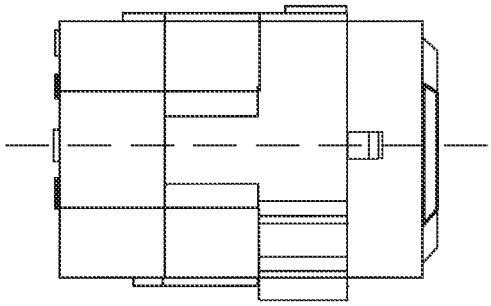
Figure 5D:
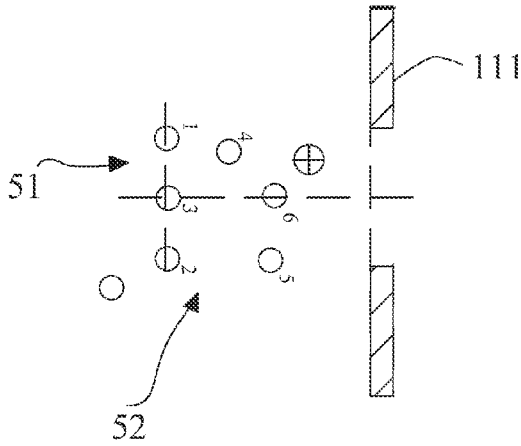
FIG. 5D is a schematic plan view of connections between the XLR/TRS combo jack and the printed circuit board of FIG. 3.

FIGS. 5A-5C are front, side and top views respectively of a connector unit 50 (an XLR/TRS combo jack, that is, a representative one of C1-C8) used in an embodiment of the disclosure. FIG. 5D is a top plan view, so that a cross section of front panel 111 with a mounting hole therethrough is shown, the profile of unit 50 is shown by a dashed line. The connector unit makes a ground connection 54 to the PCB. A set of solder connections 51 connect traces of the PCB to the XLR connectors respectively. A set of solder connections 52 connect traces of the PCB to the TRS connectors respectively.

It will be appreciated that a patchbay according to an embodiment of the disclosure is a compact, pass-through style patch panel (a 1 U rack unit) that provides on its face panel eight balanced XLR mic inputs, eight balanced TRS line inputs, eight balanced TRS half-normalled insert points, and eight balanced TRS outputs; and on its rear panel DB25 connectors for Mic in, Line in, Send, Return, and Out, allowing simple and intuitive connection to preamps and converters utilizing the DB25 TASCAM pinout.

While the disclosure has been described in terms of specific embodiments, it is evident in view of the foregoing description that numerous alternatives, modifications and variations will be apparent to those skilled in the art. Accordingly, the disclosure is intended to encompass all such alternatives, modifications and variations which fall within the scope and spirit of the disclosure and the following claims.

I claim:

1. An apparatus comprising:

a patchbay having a front panel with a plurality of types of front connector units mounted thereon;

a rear panel with rear connector units mounted thereon, different from the front connector units;

a circuit board extending from the front panel to the rear panel, the circuit board having conducting traces electrically connecting the front connector units with the rear connector units, wherein the rear connector units include multipin connectors each having at least 24 pins and thereby providing connections to eight channels with three traces in each channel, a first type of front connector unit is configured to receive an XLR input and connect to a first set of three traces forming a channel for transmitting XLR signals to a first rear connector unit, a second type of front connector unit is configured to receive a TRS input and connect to a second set of three traces forming a channel for transmitting TRS signals to a second rear connector unit.

2. An apparatus according to claim 1, wherein the rear connector units comprise five DB25 connectors, each configured to connect to eight channels.

3. An apparatus according to claim 1, wherein the first type of front connector unit is a combination jack configured to receive a TRS input and to connect to a set of three traces forming a channel for transmitting TRS signals to a rear connector unit other than the first rear connector unit.

4. An apparatus according to claim 1, wherein the front connector units of the second type comprise an insert section and an output section, and the insert section has pairs of TRS jacks configured for half-normalled operation.

5. An apparatus according to claim 4, wherein each pair of TRS jacks of the insert section includes a top jack and a bottom jack, so that insertion of a patch cord into the top jack retains an internal link between the top jack and the bottom jack, and insertion of a patch cord into the bottom jack breaks the internal link between the top jack and the bottom jack.

6. An apparatus according to claim 1, wherein the circuit board is a two-layer printed circuit board.

7. An apparatus according to claim 2, wherein the DB25 connectors respectively connect to channels for Mic in, Line in, Preamp out, A/D in, and D/A out, the front connector units of the first type are XLR/TRS combination jacks connecting to the Mic in channels and the Line in channels, the front connector units of the second type are TRS jacks comprising an insert section and an output section, the TRS jacks of the insert section connecting to the Preamp out channels and the ND in channels, and the TRS jacks of the output section connecting to the D/A out channels.

8. An apparatus according to claim 1, wherein the front connector units and the rear connector units are soldered directly to the circuit board.

9. An apparatus comprising a patchbay, including:

a front panel having mounted thereon a plurality of XLR/TRS combination jacks, a first set of pairs of TRS jacks, and a second set of pairs of TRS jacks;

a rear panel having mounted thereon a plurality of DB25 connectors;

a circuit board extending from the front panel to the rear panel, the circuit board having conducting traces, each set of three conducting traces forming a channel, each channel connected to one of the DB25 connectors;

wherein respective ones of the DB25 connectors connect to channels for Mic in, Line in, Preamp out, ND in, and D/A out, each of the XLR/TRS combination jacks is connected to a Mic in channel and to a Line in channel, one of each pair of the TRS jacks in the first set is connected to a Preamp out channel and the other of said pair is connected to an A/D in channel, and each of the TRS jacks in the second set is connected to a D/A out channel.

10. An apparatus according to claim 9, wherein the rear panel has five DB25 connectors mounted thereon, each configured to connect to eight channels, the front panel has eight XLR/TRS combination jacks mounted thereon, the first set comprises eight pairs of TRS jacks, and the second set comprises four pairs of TRS jacks.

11. An apparatus according to claim 1, wherein the first set of pairs of TRS jacks comprises an insert section, the second set of pairs of TRS jacks comprises an output section, and the pairs of TRS jacks in the insert section are configured for half-normalled operation.

12. An apparatus according to claim 11, wherein each pair of TRS jacks of the insert section includes a top jack and a bottom jack, so that insertion of a patch cord into the top jack retains an internal link between the top jack and the bottom jack, and insertion of a patch cord into the bottom jack breaks the internal link between the top jack and the bottom jack.

13. An apparatus according to claim 9, wherein the circuit board is a two-layer printed circuit board.

14. An apparatus according to claim 9, wherein the combination jacks, the TRS jacks and the DB25 connectors are soldered directly to the circuit board.

* * * * *